US006683281B2

(12) United States Patent
Sundberg et al.

(10) Patent No.: US 6,683,281 B2
(45) Date of Patent: Jan. 27, 2004

(54) MEANS AND METHOD FOR HEATING

(75) Inventors: Mats Sundberg, Vasteras (SE); Lars-Goran Johansson, Hallstahammar (SE); Helena Johansson, Vasteras (SE); Jan Andersson, Hallstahammar (SE)

(73) Assignee: Kanthal AB, Hallstahammer (SE)

( * ) Notice: Subject to any disclaimer, the term of this patent is extended or adjusted under 35 U.S.C. 154(b) by 0 days.

(21) Appl. No.: 10/182,981

(22) PCT Filed: Feb. 6, 2001

(86) PCT No.: PCT/SE01/00212

§ 371 (c)(1),
(2), (4) Date: Nov. 8, 2002

(87) PCT Pub. No.: WO01/61260

PCT Pub. Date: Aug. 23, 2001

(65) Prior Publication Data

US 2003/0127446 A1 Jul. 10, 2003

(30) Foreign Application Priority Data

Feb. 18, 2000 (SE) ..... 0000529

(51) Int. Cl.[7] ..... F27D 11/02; F27D 1/00
(52) U.S. Cl. ..... 219/405; 219/411
(58) Field of Search ..... 219/405, 411

(56) References Cited

U.S. PATENT DOCUMENTS

| | | | | |
|---|---|---|---|---|
| 2,419,643 A | | 4/1947 | Hudson | |
| 4,244,686 A | | 1/1981 | Scott, Jr. | |
| 4,493,088 A | * | 1/1985 | Lugscheider et al. | 373/22 |
| 5,561,735 A | * | 10/1996 | Camm | 219/405 |

FOREIGN PATENT DOCUMENTS

| | | | |
|---|---|---|---|
| DE | 412051 | | 4/1925 |
| DE | 2555284 | | 6/1977 |
| DE | 3005152 | | 8/1981 |
| GB | 1086868 | | 10/1967 |
| GB | 1115795 | | 5/1968 |
| GB | 1 358 356 | | 7/1974 |
| GB | 1539109 | | 1/1979 |
| JP | 62-247017 | * | 10/1987 |
| RU | 1812228 | * | 4/1993 |

* cited by examiner

*Primary Examiner*—Joseph Pelham
(74) *Attorney, Agent, or Firm*—Merchant & Gould, P.C.

(57) ABSTRACT

The present invention is for a method for heating of blanks and other heating of metallic materials in a furnace before working where heat is transferred to a blank in the furnace by radiation. According to the method of the invention an important part of the radiation hits the walls of the furnace and are reflected there before it is transferred to the blank. Preferably the furnace is designed so that head radiation is reflected also at the bottom of the furnace. At least 50% of the radiation which reaches the blank ought to be reflected radiation. The invention is also for a furnace for heating of blanks and other comprising at least one furnace bottom part (1) and at least one furnace top part (4) having side walls (5, 6, 7, 8) where at least parts of the side walls of the top parts are inclined so that opposite walls are inclined towards each other.

5 Claims, 3 Drawing Sheets

MEANS AND METHOD FOR HEATING

The present invention is for method and device for heating of billets and other heating of metallic materials for subsequent working.

Cast billets of steel and other metal alloys which shall be rolled or worked upon in other ways often have to be heated before these operations, this procedure is named billet heating. Also plates made from steel, aluminium and other metals have to be heated before rolling or other working. The temperature of the blank which one desires to achieve varies depending upon the composition of the alloy and other factors, for certain aluminium alloys from about 400° C. and up to 1200–1300° C. or more for alloys which are intended to be used at high operating temperatures. In order to create good conditions for the following procedure the temperature of the blank ought to be as uniform as possible.

It is known in the art to use heating furnaces where the source of heat is combustion or electrical resistance elements, for heating of billets so called walking beam furnaces are often used. In order to obtain a uniform distribution of the heat in electrically heated furnaces the elements are positioned at the walls and or ceiling of the furnace and often covers major parts of them. Also other kinds of electrically heated heat sources such as tungsten lamps have been used to a limited extent for some special purposes. In a conventional furnace, most often a walking beam or pusher type furnace, the blank rests on walking beams or a "cold" bottom. This causes large variations of the temperature in the blank, especially during the initial heating phase. For this reason the blanks are often deformed and may sometimes look like bananas. These kinds of furnaces also in most cases have a long delay at changes of the temperature why resetting from one operating temperature to another will be time consuming.

A uniform and simultaneous heating of the blank may have deciding importance for the final result when it goes about metallurgically advanced alloys. HF-heating is sometimes used for blanks having homogenous cross section. The advantage thereof is the compactness of the heater, the disadvantage is also in this case the difficulty to achieve a uniform heating. The water cooling which is required takes a lot of energy and a poor power factor (cos $\phi$) will be the result unless large condensor batteries are used.

It is also known to use heaters where the heat source is IR-radiators having tungsten lamps and air-cooled reflectors. The use of these is limited to typical low temperature applications, up to 4–500° C., e.g. preheating of aluminium blanks before extrusion. Already at these temperatures "counter radiation" is a problem, the air cooling has to be increased to be sufficient for lamps and reflectors, and consequently the efficiency becomes low.

It is the object of the present invention to obtain a device for heating of billets and other heating of metallic materials be means of which the said disadvantages can be avoided or essentially reduced. It is thus one object of the invention to enable rapid and uniform heating of the billet or the material so the time for equalisation of the temperature after heating will be as short as possible. It is a further object of the invention to enable rapid temperature resettings and other adaptions to various blanks and alloys. It is a further obct to rapidly reach a balanced temperature. It is also an object of the invention to obtain energy saving relative to other kinds of heating device due to a good overall efficiency. In the following billets and blanks and heating of billets and blanks shall be understood to include also other metallic bodies and various situations of heating of metallic material before working.

The device according to the invention comprises modules in the shape of hoods a number of which as required, one or more, is placed over the blank which is to be heated. A module according to the invention comprises a hood made from fibrous material. Inside the hood there are built in one or more electrical heating elements so that due to reflection of IR-radiation from the insulation of the walls heating will take place symmetrically on all sides of the blank. The element modules and the walls are designed so that as uniform heat transfer to the blank as possible shall be brought about. Multiple element modules are used depending upon the length of the blank in the case of a batch furnace, or the necessary time inside the furnace in case of a continuous furnace. The modules or hoods are placed above a furnace bottom which is so designed that it will reflect heat radiation to the sides and bottom of the blank if it is placed on suitable supports or other means so that it does not rest directly on the bottom of the furnace. In order to achieve this the device is made so that major parts of the walls of the modules and the bottom of the furnace are at an angle to a vertical plane so that the reflected radiation is directed at the blank.

One advantage of the proposed design is the possibility of rapid temperature resettings and flexibility. This is of special importance in production where several alloys are processed which require different temperatures. It is also possible to achive a heat balance rapidly as an optimal low weight and efficient insulation has been selected. This also brings energy saving with it as the set working temperature is reached rapidly without preceding hold heating. The consequences of standstill due to exchange of elements and repair of wall covering will be small compared to using a large furnace of walking beam or push types. Several units of the proposed design are intended to replace a larger furnace of one of said kinds. For higher temperatures the best and economically most feasible solution is ceramic elements with reflectors made from ceramic fibres.

The method for heating and the heating device according to the invention and embodiments thereof have the characteristics which are mentioned in the claims.

The invention will below be described more in detail with reference to the example of an embodiment which is shown in the enclosed drawings.

Figure 1:
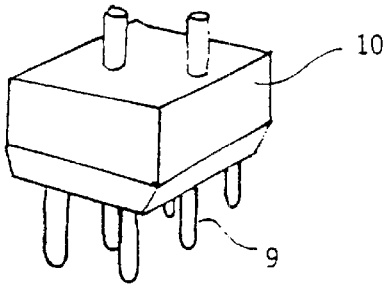
FIG. 1 shows an element unit for a billet heater.
Figure 2:
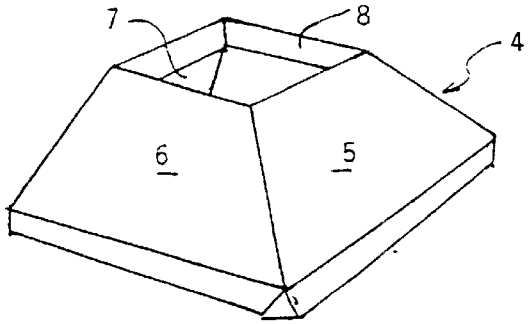
FIG. 2 shows a hood for a billet heater.
Figure 3:
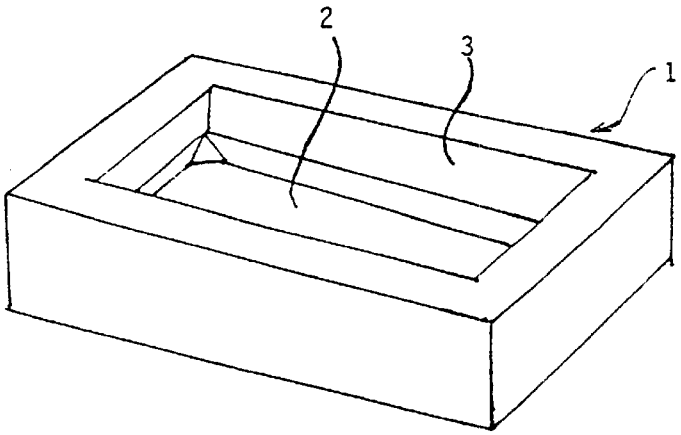
FIG. 3 shows a bottom part of a billet heater.
Figure 4:
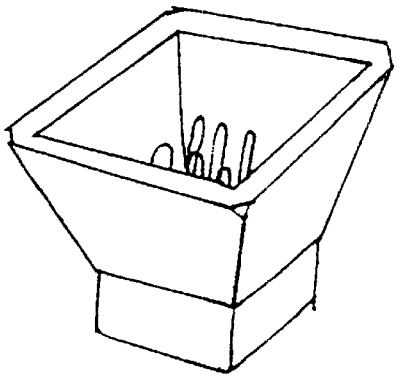
FIG. 4 shows from below a hood with an element unit.

A heating device according to the invention in principle comprises the units which are shown in FIGS. 1–5. The essential parts are a bottom part 1 in which the blank is put for heating. The bottom part has a bottom surface 2 which is surrounded by a raised, all around edge 3 which forms the four side walls of the bottom part. Preferably the blank is put on some kind of support means so that radiation may be reflected from the top of the bottom of the bottom part up at the underside of the blank. On or more top parts 4 are then put as covers on the bottom part. The side walls 5, 6, 7, 8 of the top part are inclined so that opposite walls extend themselves inwards towards each other. At the uppermost part of the top part there is one or more radiation elements which extend themselves within the volume that is defined by the inclined walls. The radiation elements are mounted in holder means 10 and form a unit together with them. Preferably the radiation elements are electrical resistance elements having an operating temperature which is more than 1400° C., preferably about 1450° C. There is one radiation element in each top part which together with bottom parts and top parts delimit a closed volume. In another embodiment of the invention top parts and bottom parts together define a tunnel having inlet and outlet openings.

Figure 5:
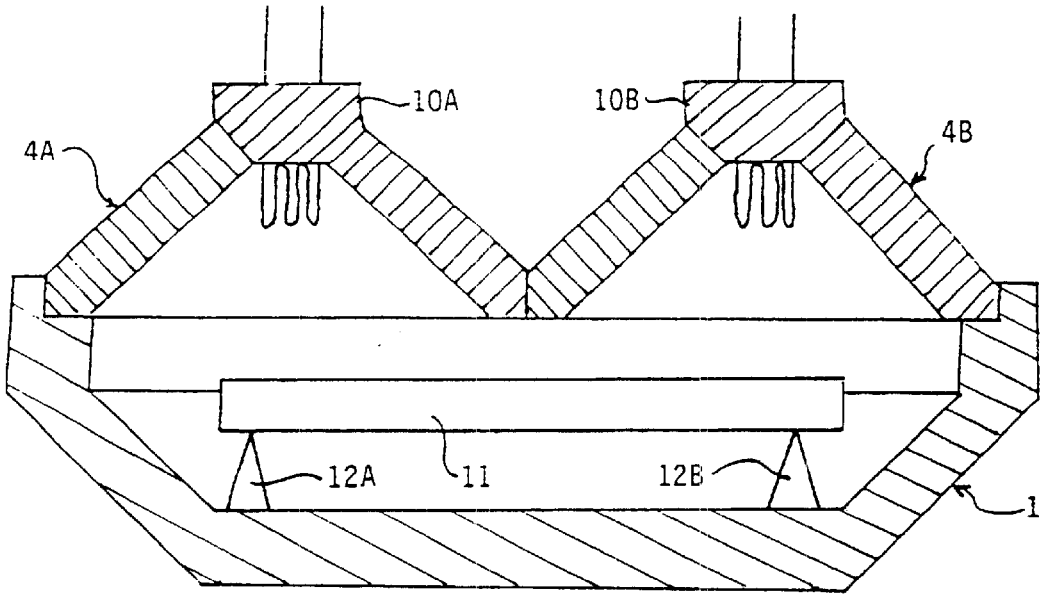
FIG. 5 is a cross section of a furnace according to the invention.
Figure 6:
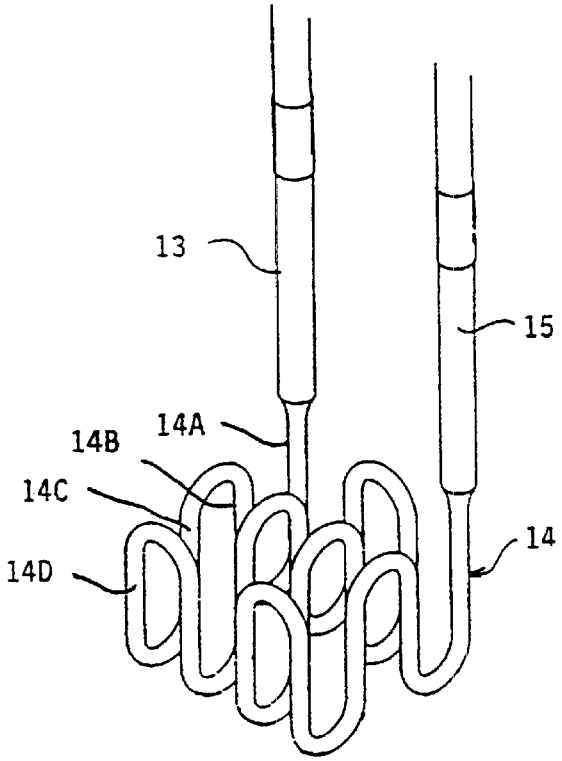
FIG. 6 shows an example of an electrical resistance element for a furnace according to FIGS. 1–5.

The cross section of a furnace as shown in FIG. 5 comprises a bottom part 1 on top of which two top parts 4A, 4B have ben put. In each top part there is an electrical resistance element in an element unit 10A, 10B. A blank 1 has been put into the oven on two supports 12A, 12B. The bottom part of the furnace is of rectangular shape and it has, as shown in the figure, inner side walls which are inclined in a similar way as the side walls of the top parts. All sides of the blank 11 may be subject to reflected radiation. The heat sources may be concentrated to a few positions, one in each of the top parts and by reflection the heat is distributed over the blank so that a equalised and uniform heating is attained. Preferably more than 50% of the total heat radiation which reaches the blank is reflected radiation.

The radiation elements must be of high power in order to produce the required amount of radiated heat per unit time. Thus they are preferably made as electrical resistance elements in the shape of wire or band which is bent so that the hot section 14 of the element has at least eight shanks (14A–14D). The elements have two connectors 13, 15. The shanks are connected to each other to a three dimensional meander shape in order to obtain a high power per unit time. In order to attain sufficiently high temperatures the elements are preferably made from molybdenum disilicide or other ceramic material.

Figure 7:
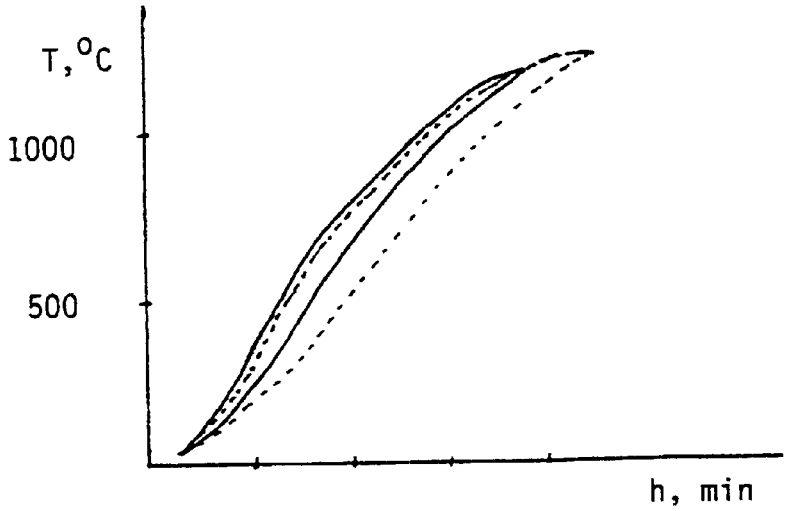
FIG. 7 is a diagram showing the temperature equalisation in a blank which has been heated in accordance with the invention.

By the invention a very good temperature uniformity is achieved within a short time, which is apparent from the diagram of FIG. 7. This shows the greatest measured difference in temperature T in the blank as a function of time h the conditions in a furnace according to the invention are shown by a full line and in the same furnace but with the bottom shielded in order to prevent reflection to the bottom of the blank is shown by a broken line. For comparison it may be mentioned that the temperature of the blanks in an electrically heated walking beam furnace may vary considerably. In a gas or oil fired furnace the variations are even greater.

Figure 8:
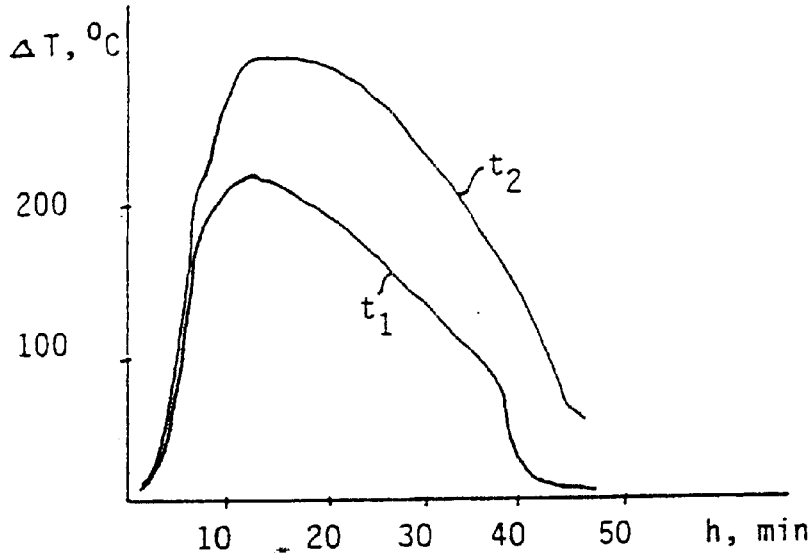
FIG. 8 is a diagram showing the effect of reflection at the bottom side of the blank.

The importance of the reflection to the bottom of the blank is apparent from the diagram of FIG. 8, which shows the temperature difference $\Delta T$ between the top and the bottom of the blank as a function of time h. It appears that at normal heating according to the invention, line $t_1$, without shielding of the reflection to the bottom of the blank, the uniformity of the temperature will much better than if reflection to the bottom of the blank is prevented, line $t_2$. Moreover heating is faster.

The above described embodiments of the invention are in no way limiting and within the frame of the inventive idea the embodiments may be varied in various ways in addition to what has been described.

What is claimed is:

1. Heating furnace in which heat is transferred to a blank in the furnace by radiation and an essential fraction of the radiation hits the walls of the furnace and are reflected by them before it is transmitted to the blank characterized in that it comprises at least one furnace bottom part (1) and at least one furnace top part (4) having side walls (5, 6, 7, 8) where at least parts of the side walls of the top part are inwardly inclined towards each other and that in the upper part of the top part (4) there are one or more radiation elements (9) having the shape of rod or strip (14) and extending in three dimensions within the volume which is defined by the inclined walls.

2. Furnace according to claim 1 characterized in that heat radiation is reflected also by the bottom of the furnace.

3. Furnace according to claim 1 characterized in that at least 50% of the radiation which reaches the blank is reflected radiation.

4. Furnace according to claim 1 characterized in that the operating temperatures of the elements (9) is above 1400° C.

5. Furnace according to claim 1 characterized in that one or more elements comprise at least eight meander shaped shanks (14A–14D).

* * * * *